US008524070B2

(12) United States Patent
Strack et al.

(10) Patent No.: US 8,524,070 B2
(45) Date of Patent: Sep. 3, 2013

(54) METHOD FOR PROCESSING HYDROCARBON PYROLYSIS EFFLUENT

(75) Inventors: Robert David Strack, Houston, TX (US); John R. Messinger, Kingwood, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1933 days.

(21) Appl. No.: 11/178,037

(22) Filed: Jul. 8, 2005

(65) Prior Publication Data

US 2007/0007174 A1 Jan. 11, 2007

(51) Int. Cl.
*C10G 9/00* (2006.01)

(52) U.S. Cl.
USPC ..... 208/106; 208/48 Q

(58) Field of Classification Search
None
See application file for complete search history.

(56) References Cited

U.S. PATENT DOCUMENTS

| | | | |
|---|---|---|---|
| 2,343,192 | A | 2/1944 | Kuhn |
| 2,695,264 | A | 11/1954 | Taff et al. |
| 2,901,418 | A | 8/1959 | Pappas |
| 3,060,116 | A | 10/1962 | Hardin, Jr. et al. |
| 3,498,906 | A | 3/1970 | Bogart et al. |
| 3,529,030 | A | 9/1970 | Chin |
| 3,593,968 | A | 7/1971 | Geddes |
| 3,647,907 | A | 3/1972 | Sato et al. |
| 3,676,519 | A | 7/1972 | Dorn et al. |
| 3,907,661 | A | 9/1975 | Gwyn et al. |
| 3,923,921 | A | 12/1975 | Kohfeldt |
| 3,959,420 | A | 5/1976 | Geddes et al. |
| 4,107,226 | A | 8/1978 | Ennis, Jr. et al. |
| 4,121,908 | A | 10/1978 | Raab et al. |
| 4,150,716 | A | 4/1979 | Ozaki et al. |
| 4,166,830 | A | 9/1979 | Guth et al. |
| 4,233,137 | A | 11/1980 | Ozaki et al. |
| 4,279,733 | A | 7/1981 | Gwyn |
| 4,279,734 | A | 7/1981 | Gwyn |
| 4,420,343 | A | 12/1983 | Sliwka |
| 4,444,697 | A | 4/1984 | Gater et al. |

(Continued)

FOREIGN PATENT DOCUMENTS

| | | |
|---|---|---|
| EP | 205 205 | 12/1986 |
| EP | 1 063 273 | 12/2000 |

(Continued)

OTHER PUBLICATIONS

Lohr et al., "Steam-cracker Economy Keyed to Quenching," Oil Gas Journal, vol. 76 (No. 20), pp. 63-68, (1978).

(Continued)

*Primary Examiner* — Tam M Nguyen

(57) ABSTRACT

A method and apparatus are disclosed for treating the effluent from a hydrocarbon pyrolysis unit employing a small primary fractionator, i.e., a rectifier. The method comprises cooling the gaseous effluent, e.g., by direct quench and/or at least one primary heat exchanger, and then cooling the gaseous effluent to a temperature at which tar, formed by reactions among constituents of the effluent, condenses, e.g., in a secondary exchanger. The resulting mixed gaseous and liquid effluent is passed through a rectifier, to cleanly separate quench oil from the gaseous effluent comprising a pyrolysis gasoline fraction, whose boiling point can be lowered as a result of the rectifier treatment. The effluent is then cooled to condense a liquid effluent comprising pyrolysis gasoline and water condensed from steam, which fractions are separated in a distillate drum. The cooled gaseous effluent is directed to a recovery train to recover light olefins. At least a portion of the pyrolysis gasoline-containing fraction can be recycled to the rectifier to enhance separation of the quench oil from the pyrolysis gasoline fraction.

23 Claims, 1 Drawing Sheet

(56) References Cited

U.S. PATENT DOCUMENTS

| | | | |
|---|---|---|---|
| 4,446,003 | A | 5/1984 | Burton et al. |
| 4,457,364 | A | 7/1984 | DiNicolantonio et al. |
| 4,520,760 | A | 6/1985 | Covell |
| 4,581,899 | A | 4/1986 | von Klock et al. |
| 4,614,229 | A | 9/1986 | Oldweiler |
| 4,702,818 | A | 10/1987 | Oyamoto et al. |
| 4,945,978 | A | 8/1990 | Herrmann |
| 5,092,981 | A | 3/1992 | Russo |
| 5,107,921 | A | 4/1992 | Tsai |
| 5,139,650 | A | 8/1992 | Lenglet |
| 5,147,511 | A | 9/1992 | Woebcke |
| 5,271,827 | A | 12/1993 | Woebcke |
| 5,294,347 | A | 3/1994 | Byrne et al. |
| 5,324,486 | A | 6/1994 | Russo |
| 5,579,831 | A | 12/1996 | Brucher |
| 5,690,168 | A | 11/1997 | Cizmar et al. |
| 5,756,055 | A | 5/1998 | Kelly et al. |
| 6,148,908 | A | 11/2000 | Brucher |
| 6,183,626 | B1 | 2/2001 | Lenglet et al. |
| 6,271,431 | B1 | 8/2001 | Busson et al. |
| 6,626,424 | B2 | 9/2003 | Ngan et al. |
| 2003/0031612 | A1 | 2/2003 | Raynal et al. |

FOREIGN PATENT DOCUMENTS

| | | |
|---|---|---|
| EP | 0 031 609 | 8/2001 |
| GB | 1233795 | 5/1971 |
| GB | 1309309 | 3/1973 |
| GB | 1390382 | 4/1975 |
| JP | 2001-40366 | 2/2001 |
| WO | WO 93/12200 | 6/1993 |
| WO | WO 97/13097 | 4/1997 |
| WO | WO 00/56841 | 9/2000 |

OTHER PUBLICATIONS

Kister, Henry Z., *Distillation Design*, Chapter 6 "*Tray Design and Operation*", pp. 259-363, Chapter 8 "*Packing Design and Operation*", pp. 421-521, McGraw-Hill, Inc., Copyright © 1992.

Herrmann, H. & Burghardt, W., "*Latest Developments in Transfer Line Exchanger Design for Ethylene Plants*", Schmidt'sche-Heissdampf-Gesellschaft, pp. 193-228, Apr. 1994.

Mukherjee, R., "*Effectively Design Shell-and-Tube Heat Exchangers*", 94 Chem. Engr. Progress, pp. 21-37, (1998).

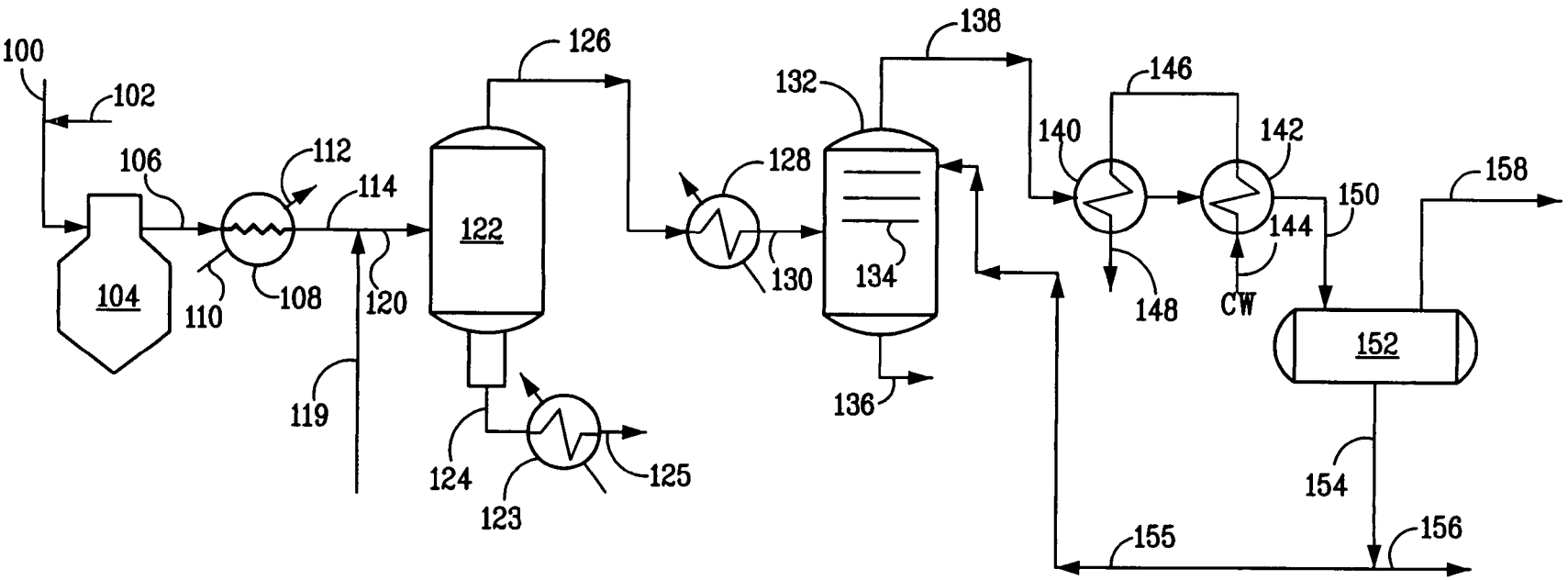
100
102
104
106
108
110
112
114
119
120
122
123
124
125
126
128
130
132
134
136
138
140
142
144
146
148
150
152
154
155
156
158
CW

METHOD FOR PROCESSING HYDROCARBON PYROLYSIS EFFLUENT

CROSS-REFERENCE TO RELATED APPLICATIONS

The present application expressly incorporates by reference herein the entire disclosures of Ser. No. 11/177,975, entitled "METHOD FOR PROCESSING HYDROCARBON PYROLYSIS EFFLUENT", Ser. No. 11/178,158, entitled "METHOD FOR COOLING HYDROCARBON PYROLYSIS EFFLUENT", Ser. No. 11/177,125, entitled "METHOD FOR PROCESSING HYDROCARBON PYROLYSIS EFFLUENT", Ser. No. 11/177,075, entitled "METHOD FOR PROCESSING HYDROCARBON PYROLYSIS EFFLUENT", and Ser. No. 11/178,025, entitled "METHOD FOR PROCESSING HYDROCARBON PYROLYSIS EFFLUENT", all of which are incorporated herein by reference and concurrently filed with the present application.

FIELD OF THE INVENTION

The present invention is directed to a method for processing the gaseous effluent from hydrocarbon pyrolysis units, especially those units utilizing feeds that are heavier than naphtha.

BACKGROUND OF THE INVENTION

The production of light olefins (ethylene, propylene and butenes) from various hydrocarbon feedstocks utilizes the technique of pyrolysis, or steam cracking. Pyrolysis involves heating the feedstock sufficiently to cause thermal decomposition of the larger molecules. The pyrolysis process, however, produces molecules which tend to combine to form high molecular weight materials known as tars. Tars are high-boiling point, viscous, reactive materials that can foul equipment under certain conditions.

The formation of tars, after the pyrolysis effluent leaves the steam cracking furnace can be minimized by rapidly reducing the temperature of the effluent exiting the pyrolysis unit to a level at which the tar-forming reactions are greatly slowed.

One technique used to cool pyrolysis unit effluent and remove the resulting heavy oils and tars employs heat exchangers followed by a water quench tower in which the condensibles are removed. This technique has proven effective when cracking light gases, primarily ethane, propane and butane, because crackers that process light feeds, collectively referred to as gas crackers, produce relatively small quantities of tar. As a result, heat exchangers can efficiently recover most of the valuable heat without fouling and the relatively small amount of tar can be separated from the water quench albeit with some difficulty.

This technique is, however, not satisfactory for use with steam crackers that crack naphthas and heavier feedstocks, collectively referred to as liquid crackers, since liquid crackers generate much larger quantities of tar than gas crackers. Heat exchangers can be used to remove some of the heat from liquid cracking, but only down to the temperature at which tar begins to condense. Below this temperature, conventional heat exchangers cannot be used because they would foul rapidly from accumulation and thermal degradation of tar on the heat exchanger surfaces. In addition, when the pyrolysis effluent from these feedstocks is quenched, some of the heavy oils and tars produced have approximately the same density as water and can form stable oil/water emulsions. Moreover, the larger quantity of heavy oils and tars produced by liquid cracking would render water quench operations ineffective, making it difficult to remove heat from the condensed water and to dispose of excess quench water and the heavy oil and tar in an environmentally acceptable manner.

Accordingly, in most commercial liquid crackers, cooling of the effluent from the cracking furnace is normally achieved using a system of transfer line heat exchangers, a primary fractionator, and a water quench tower or indirect condenser. For a typical heavier than naphtha feedstock, the transfer line heat exchangers cool the process stream to about 371° to about 649° C. (700° to 1200° F.) (with the temperature depending on the quality of the feedstock), efficiently generating super-high pressure steam which can be used elsewhere in the process. The primary fractionator is normally used to condense and separate the tar from the lighter liquid fraction, known as pyrolysis gasoline, and to recover the heat down to about 93° C. (200° F.), and can utilize a direct quench point where quench oil is added to cool the stream sufficiently to condense tar present in the stream. The water quench tower or indirect condenser further cools the gas stream exiting the primary fractionator to about 40° C. (100° F.) to condense the bulk of the dilution steam present and to separate pyrolysis gasoline from the gaseous olefinic product, which is then sent to a compressor. Sometimes an intermediate boiling range stream known as steam cracked gas oil boiling, say, within the range of about 177° to about 287° C. (350° to 550° F.), is also produced as a sidestream.

The primary fractionator, however, is a very complex piece of equipment that typically includes an oil quench section, a primary fractionator tower and one or more external oil pumparound loops. At the quench section, quench oil is added to cool the effluent stream to about 200° to about 290° C. (400° to 550° F.), thereby condensing tar present in the stream. In the primary fractionator tower, the condensed tar is separated from the remainder of the stream, heat is removed in one or more pumparound zones by circulating oil and a pyrolysis gasoline fraction is separated from heavier material in one or more distillation zones. In the one or more external pumparound loops, oil, which is withdrawn from the primary fractionator, is cooled using indirect heat exchangers and then returned to the primary fractionator or the direct quench point.

The primary fractionator with its associated pumparounds is the most expensive component in the entire cracking system. The primary fractionator tower itself is the largest single piece of equipment in the process, typically being about twenty-five feet in diameter and over a hundred feet high for a medium size liquid cracker. The tower is large because it is in effect fractionating two minor components, tar and pyrolysis gasoline, in the presence of a large volume of low pressure gas. The pumparound loops are likewise large, handling over 1.3 million kilograms per hour (3 million pounds per hour) of circulating oil in the case of a medium size cracker. Heat exchangers in the pumparound circuit are necessarily large because of high flow rates, close temperature approaches needed to recover the heat at useful levels, and allowances for fouling.

In addition, the primary fractionator has a number of other limitations and problems. In particular, heat transfer takes place twice, i.e., from the gas to the pumparound liquid inside the tower and then from the pumparound liquid to the external cooling service. This effectively requires investment in two heat exchange systems, and imposes two temperature approaches (or differentials) on the removal of heat, thereby reducing thermal efficiency.

Moreover, despite the fractionation that takes place between the tar and gasoline streams, both streams often need to be processed further. Sometimes the tar needs to be stripped to remove light components, whereas the gasoline may need to be refractionated to meet its end point specification.

Further, the primary fractionator tower and its pumparounds are prone to fouling. Coke accumulates in the bottom section of the tower and must eventually be removed during plant turnarounds. The pumparound loops are also subject to fouling, requiring removal of coke from filters and periodic cleaning of fouled heat exchangers. Trays and packing in the tower are sometimes subject to fouling, potentially limiting plant production. The system also contains a significant inventory of flammable liquid hydrocarbons, which is not desirable from an inherent safety standpoint.

There is therefore a need for a simplified method for cooling pyrolysis unit effluent and removing the resulting heavy oils and tars which obviates the need for a primary fractionator tower and its ancillary equipment, even where steam cracked gas oil is produced.

The present invention seeks to provide a simplified method for treating pyrolysis unit effluent, particularly the effluent from the steam cracking of hydrocarbonaceous feeds that are heavier than naphthas. Heavy feed cracking is often more economically advantageous than naphtha cracking, but in the past it suffered from poor energy efficiency and higher investment requirements. The present invention optimizes recovery of the useful heat energy resulting from heavy feed steam cracking without fouling of the cooling equipment. This invention replaces a primary fractionator tower and its ancillary equipment, e.g., pumparounds, with simpler apparatus capable of utilizing low level heat present in the stream being processed to distill liquid components.

U.S. Pat. Nos. 4,279,733 and 4,279,734 propose cracking methods using a quencher, indirect heat exchanger and fractionator to cool effluent, resulting from steam cracking.

U.S. Pat. Nos. 4,150,716 and 4,233,137 propose a heat recovery apparatus comprising a pre-cooling zone where the effluent resulting from steam cracking is brought into contact with a sprayed quenching oil, a heat recovery zone, and a separating zone.

Lohr et al., "Steam-cracker Economy Keyed to Quenching," Oil & Gas Journal, Vol. 76 (No. 20), pp. 63-68, (1978), proposes a two-stage quenching involving indirect quenching with a transfer line heat exchanger to produce high-pressure steam along with direct quenching with a quench oil to produce medium-pressure steam.

U.S. Pat. Nos. 5,092,981 and 5,324,486 propose a two-stage quench process for effluent resulting from steam cracking furnace comprising a primary transfer line exchanger which functions to rapidly cool furnace effluent and to generate high temperature steam and a secondary transfer line exchanger which functions to cool the furnace effluent to as low a temperature as possible consistent with efficient primary fractionator or quench tower performance and to generate medium to low pressure steam.

U.S. Pat. No. 5,107,921 proposes transfer line exchangers having multiple tube passes of different tube diameters. U.S. Pat. No. 4,457,364 proposes a close-coupled transfer line heat exchanger unit.

U.S. Pat. No. 3,923,921 proposes a naphtha steam cracking process comprising passing effluent through a transfer line exchanger to cool the effluent and thereafter through a quench tower.

WO 93/12200 proposes a method for quenching the gaseous effluent from a hydrocarbon pyrolysis unit by passing the effluent through transfer line exchangers and then quenching the effluent with liquid water so that the effluent is cooled to a temperature in the range of 105° C. to 130° C., such that heavy oils and tars condense, as the effluent enters a primary separation vessel. The condensed oils and tars are separated from the gaseous effluent in the primary separation vessel and the remaining gaseous effluent is passed to a quench tower where the temperature of the effluent is reduced to a level at which the effluent is chemically stable.

EP 205 205 proposes a method for cooling a fluid such as a cracked reaction product by using transfer line exchangers having two or more separate heat exchanging sections.

U.S. Pat. No. 5,294,347 proposes that in ethylene manufacturing plants, a water quench column cools gas leaving a primary fractionator and that in many plants, a primary fractionator is not used and the feed to the water quench column is directly from a transfer line exchanger.

JP 2001-40366 proposes cooling mixed gas in a high temperature range with a horizontal heat exchanger and then with a vertical heat exchanger having its heat exchange planes installed in the vertical direction. A heavy component condensed in the vertical exchanger is thereafter separated by distillation at downstream refining steps.

WO 0056841; GB 1,390,382; GB 1,309,309; and U.S. Pat. Nos. 4,444,697; 4,446,003; 4,121,908; 4,150,716; 4,233,137; 3,923,921; 3,907,661; and 3,959,420; propose various apparatus for quenching a hot cracked gaseous stream wherein the hot gaseous stream is passed through a quench pipe or quench tube wherein a liquid coolant (quench oil) is injected.

All of the foregoing U.S. patents and other references are incorporated herein by reference in their entirety.

SUMMARY OF THE INVENTION

In one aspect, the present invention is directed to a method for treating gaseous effluent from a hydrocarbon pyrolysis unit, the method comprising: (a) cooling the gaseous effluent at least to a temperature at which tar, formed by reaction among constituents of the effluent, condenses; (b) passing the mixed gaseous and liquid effluent from step (a) through at least one vapor-liquid separator, where the condensed tar separates from the gaseous effluent; (c) cooling the gaseous effluent from step (b) to condense a liquid effluent quench oil; (d) passing at least a portion of the effluent from step (c) through at least one rectifier comprising a reflux inlet for introducing a pyrolysis gasoline fraction; (e) cooling the gaseous effluent from step (d) to condense a liquid effluent comprising pyrolysis gasoline and water condensed from steam; (f) treating the mixed gaseous and liquid effluent from step (e) to at least partially separate therefrom a liquid pyrolysis gasoline rich stream; and (g) passing at least a portion of the liquid pyrolysis gasoline rich stream as reflux to the rectifier.

Typically, the gaseous effluent is cooled in step (a) to a temperature of less than about 371° C. (700° F.), cooled in step (c) to a temperature of less than about 316° C. (600° F.), and cooled in step (e) to a temperature of less than about 100° C. (220° F.), e.g., the gaseous effluent is cooled in step (a) to a temperature ranging from about 204° to about 316° C. (400 to 600° F.), cooled in step (c) to a temperature ranging from about 93° to about 232° C. (200° to 450° F.), and cooled in step (e) to a temperature ranging from about 15° to about 93° C. (60° to 200° F.), say, the gaseous effluent is cooled in step (a) to a temperature ranging from about 249° to about 293° C. (480° to 560° F.), cooled in step (c) to a temperature ranging from about 121° to about 176° C. (250° to 350° F.), and cooled in step (e) to a temperature ranging from about 32° to about 88° C. (90° to 190° F.).

The liquid pyrolysis gasoline rich stream typically has an initial boiling point of less than about 66° C. (150° F.) and a final boiling point in excess of about 149° C. (300° F.), say, a final boiling point ranging from about 177° to about 454° C. (350° to 850° F.).

In one embodiment, step (a) of the method includes passing the effluent through a primary heat exchanger which provides steam having a temperature of at least about 254° C. (489° F.) and pressure greater than about 4240 kPa (600 psig), say, a temperature ranging from about 254° to about 677° C. (489° to 1250° F.) and pressure ranging from about 4240 to about 17340 kPa (600 to 2500 psig).

In another embodiment, step (a) of the method includes passing the effluent from the primary heat exchanger to a secondary heat exchanger wherein at least a substantial portion of the tar is condensed.

In still another embodiment, step (a) of the method includes maintaining an outlet temperature for the primary heat exchanger above the dew point of its effluent.

In yet another embodiment, step (a) of the method is at least partially effected by direct quench of the gaseous effluent with a liquid quench stream. Typically, the liquid quench stream is selected from water and oil, e.g., the liquid quench stream can comprise condensed quench oil from step (d).

In still yet another embodiment, step (a) comprises directly contacting the gaseous effluent with a quench liquid after passage of the effluent through the primary heat exchanger. Typically, the quench liquid is selected from water and oil, e.g., the quench liquid comprises condensed quench oil from step (d).

In another embodiment, the rectifier comprises at least one tray.

In yet another embodiment, the cooling step (c) of the method is effected by indirect contact heat exchange.

In still another embodiment, at least a portion of the condensed tar is recycled to the vapor-liquid separator.

In yet another embodiment, the gaseous effluent of step (a) is derived from pyrolysis of a naphtha feed.

In yet still another embodiment, the gaseous effluent of step (a) is derived from pyrolysis of a feed heavier than naphtha.

In another embodiment of this method, the cooled gaseous effluent, liquid pyrolysis gasoline and liquid water from step (e) are at least partially separated in a distillate drum from each other to form a gaseous effluent stream which is directed to a recovery train, a liquid pyrolysis gasoline rich stream and a liquid water rich stream.

In yet another embodiment of this method, the liquid pyrolysis gasoline rich stream has a lower end point than a corresponding stream made from a corresponding method excluding step (d).

In another aspect, the present invention relates to a method for treating gaseous effluent from a hydrocarbon pyrolysis unit, the method comprising: (a) passing the gaseous effluent derived from pyrolysis of a feed heavier than naphtha through at least one primary heat exchanger, thereby cooling the gaseous effluent and generating super high pressure steam; (b) passing a mixed gaseous and liquid effluent from step (a) through at least one vapor-liquid separator, where tar, formed by reaction among constituents of the effluent is condensed and separates from the gaseous effluent; (c) cooling the gaseous effluent from step (b) to condense a liquid effluent quench oil; (d) passing the mixed gaseous and liquid effluent from step (c) through at least one rectifier comprising distillation media selected from trays and packing, and a reflux inlet for introducing a pyrolysis gasoline fraction, where condensed quench oil separates from the gaseous effluent; (e) cooling the gaseous effluent from step (d) to condense a liquid effluent comprising pyrolysis gasoline and water condensed from steam; (f) treating the gaseous and/or liquid effluent from step (e) to at least partially separate therefrom a liquid pyrolysis gasoline rich stream; and (g) passing at least a portion of the liquid pyrolysis gasoline rich stream as reflux to the rectifier.

In yet another aspect, the present invention relates to a hydrocarbon cracking apparatus comprising: (a) a reactor for pyrolyzing a hydrocarbon feedstock, the reactor having an outlet through which gaseous pyrolysis effluent can exit the reactor; (b) at least one of i) a heat exchanger connected to the reactor outlet and ii) a line for introducing quench oil downstream of the reactor outlet, for cooling the gaseous pyrolysis effluent; (c) at least one vapor-liquid separator connected to and downstream of (b) for separating tar from the gaseous effluent; (d) a cooling train connected to and downstream of the at least one vapor-liquid separator for further cooling the gaseous effluent; (e) at least one rectifier comprising at least one theoretical stage, for receiving a mixed gaseous and liquid effluent from step (d), where condensed quench oil separates from the gaseous effluent; (f) at least one cooling means selected from the group consisting of condenser and water quench tower for cooling the gaseous effluent from step (e) to condense a liquid effluent comprising pyrolysis gasoline and water condensed from steam; (g) a separator for recovering a liquid pyrolysis gasoline rich stream from the gaseous and/or liquid effluent of step (f); (h) a recovery train which recovers light olefins from the gaseous effluent from steps (f) and/or (g); and (i) a line for recycling at least a portion of the liquid pyrolysis gasoline rich stream of step (g) to the rectifier.

In one embodiment of the apparatus of the invention, the rectifier comprises at least one distillation tray and/or packing.

In another embodiment, the apparatus comprises a line for introducing quench oil from the rectifier at a point downstream of the transfer line exchanger and upstream of the vapor-liquid separator.

In yet another embodiment of the apparatus of the invention, the separator of step (g) comprises a distillate drum for receiving mixed gaseous and liquid effluent from step (f), where the cooled gaseous effluent, pyrolysis gasoline and water are at least partially separated from each other to form a gaseous effluent stream, a liquid pyrolysis gasoline rich stream, and a liquid water rich stream.

In still yet another embodiment of the apparatus of the invention, the separator of step (g) comprises a settling drum for receiving liquid from the bottoms of a water quench tower, where the condensed pyrolysis gasoline and water are at least partially separated from each other to form a liquid pyrolysis gasoline rich stream and a liquid water rich stream.

BRIEF DESCRIPTION OF THE DRAWING

FIG. 1 is a schematic flow diagram of a method according to the present invention of treating the gaseous effluent from the cracking of a gas oil feed.

DETAILED DESCRIPTION OF THE EMBODIMENTS

The present invention provides a low cost way of treating the gaseous effluent stream from a hydrocarbon pyrolysis reactor so as to remove and recover heat therefrom and to separate $C_5$+ hydrocarbons, providing separate pyrolysis gasoline and gas oil fractions (which may be suited to use as a quench oil), as well as the desired $C_2$-$C_4$ olefins in the effluent, without the need for a primary fractionator.

Typically, the effluent used in the method of the invention is produced by pyrolysis of a hydrocarbon feed boiling in a temperature range, say, from about 40° to about 704° C. (104° to 1300° F.), such as naphtha or gas oil. For example, the effluent used in the method of the invention is produced by pyrolysis of a hydrocarbon feed having a final boiling point above about 180° C. (356° F.), such as feeds heavier than naphtha. Such feeds include those boiling in the range from about 177° to about 538° C. (350° to 1000° F.), say, from about 204° to about 510° C. (400° to 950° F.). Typical heavier than naphtha feeds can include heavy condensates, gas oils, hydrocrackates, kerosene, condensates, crude oils, and/or crude oil fractions, e.g., reduced crude oils. The temperature of the gaseous effluent at the outlet from the pyrolysis reactor is normally in the range of from about 760° to about 930° C. (1400° to 1700° F.) and the invention provides a method of cooling the effluent to a temperature at which the desired $C_2$-$C_4$ olefins can be compressed efficiently, generally less than about 100° C. (212° F.), for example less than about 75° C. (167° F.), such as less than about 60° C. (140° F.), and typically from about 200° to about 50° C. (68° to about 122° F.).

In particular, the present invention relates to a method for treating the gaseous effluent from a heavy feed cracking unit, which method comprises passing the effluent through at least one primary heat exchanger, typically a transfer line exchanger, which is capable of recovering heat from the effluent down to a temperature where fouling is incipient. If needed, this heat exchanger can be periodically cleaned by steam decoking, steam/air decoking, or mechanical cleaning. Conventional indirect heat exchangers, such as tube-in-tube exchangers or shell and tube exchangers, may be used in this service. The primary heat exchanger cools the process stream to a temperature between about 340° and about 650° C. (644° and 1202° F.), such as about 370° C. (700° F.), uses water as the cooling medium and generates super high pressure steam, ranging in pressure from above about 900 psig, typically, ranging from about 900 to about 2500 psig, e.g., from about 1200 to about 1900 psig, say, about 1500 psig.

On leaving the primary heat exchanger, the cooled gaseous effluent is typically still at a temperature above the hydrocarbon dew point (the temperature at which the first drop of liquid condenses) of the effluent. For a typical heavy feed under cracking conditions, the hydrocarbon dew point of the effluent stream ranges from about 343° to about 649° C. (650° to 1200° F.), say, from about 399° to about 593° C. (750° to 1100° F.). Above the hydrocarbon dew point, the fouling tendency is relatively low, i.e., vapor phase fouling is generally not severe, and there is no liquid present that could cause fouling. Tar condenses from such heavy feeds at a temperature ranging from about 204° to about 343° C. (400° to 650° F.), say, from about 232° to about 316° C. (450° to 600° F.).

Conveniently, a secondary heat exchanger, typically a transfer line exchanger, also can be provided and is operated such that it includes a heat exchange surface cool enough to condense part of the effluent and generate a liquid hydrocarbon film at the heat exchange surface. The liquid film is generated in situ and is preferably at or below the temperature at which tar is produced, typically at about 190° C. to about 315° C., (374° to 599° F.) such as at about 230° C. (450° F.). This is ensured by proper choice of cooling medium and exchanger design. Because the main resistance to heat transfer is between the bulk process stream and the film, the film can be at a significantly lower temperature than the bulk stream. The film effectively keeps the heat exchange surface wetted with fluid material as the bulk stream is cooled, thus preventing fouling. Such a secondary heat exchanger must cool the process stream continuously to the temperature at which tar is produced. If the cooling is stopped before this point, fouling is likely to occur because the process stream would still be in the fouling regime. This secondary heat exchanger is particularly suitable for use with light liquid feeds, such as naphtha, as well as feeds which are heavier than naphtha.

The gaseous effluent from the steam cracker furnace can be subjected to direct quench, at a point typically between the furnace outlet and the tar knock-out drum. The quench can be effected by contacting the heat exchanger effluent with a liquid quench stream. Typically, the quench liquid is introduced at a point downstream of the heat exchanger. Suitable quench liquids include liquid quench oil, such as those obtained by a downstream quench oil knock-out drum, pyrolysis fuel oil, and water, which can be obtained from various suitable sources, e.g., downstream in the process.

After passage through the heat exchanger(s), and/or direct quench, the cooled effluent is fed to a tar knock-out drum where the condensed tar is separated from the effluent stream as bottoms. If desired, multiple knock-out drums may be connected in parallel such that individual drums can be taken out of service and cleaned while the plant is operating. The tar removed at this stage of the process typically has an initial boiling point ranging from about 177° to about 287° C. (350° to 550° F.), say, at least about 200° C. (392° F.).

The effluent entering the tar knock-out drum(s) should be at a sufficiently low temperature, typically at about 190° to about 315° C. (375° to 600° F.), such as at about 230° C. (450° F.), that the tar separates rapidly in the knock-out drum(s).

After removal of the tar in the tar knock-out drum(s), the gaseous effluent stream is subjected to an additional cooling sequence that includes passing the effluent through one or more cracked gas coolers, which utilize a cooling medium known to those of skill in the art, e.g., selected from boiler feed water, medium pressure steam, dilution steam, and low pressure steam. After cooling by the cracked gas cooler(s) to a temperature ranging from about 121° to about 204° C. (250° to 400° F.), such as at about 149° C. (300° F.), the cooled effluent is then directed to a rectifier (or rectifying tower), which for present purposes can be defined as a distillation tower in which the feed is introduced below the distillation stages. Typically, the rectifier will be significantly smaller in height and diameter than a primary fractionator tower, e.g., less than 50%, say, less than 20% on a volume basis. The rectifier lacks external pumparound zones utilizing circulating oil through heat exchangers, which are commonly associated with primary fractionators. The rectifier comprises an inlet for introducing a pyrolysis gasoline fraction as reflux which is preferably introduced to the rectifier at a level above the distillation stages, trays, packing, etc. The rectifier can be preferably operated at a temperature ranging from about 93° to about 204° C. (200° to 400° F.), such as at from about 104° to 149° C. (220° to 300° F.), top to bottom, to produce a heavy fraction taken as bottoms which may be used as a quench oil, typically having an initial boiling point in the range of about 660 to about 204° C. (150° to 400° F.). The rectifier typically comprises at least one distillation tray or actual stage.

The rectification tower comprises a fixed number of actual stages. The feed inlet for the rectifier is typically located beneath the actual stages in the rectifier. The inlet for reflux, say, pyrolysis gasoline is typically located above the highest distillation tray or actual stage. The number of actual stages can range from about 2 to about 20, or from about 5 to about 15, say, about 8. As used herein, the terms actual "stages" and actual "trays" are used interchangeably to mean physical contacting devices, such as bubble cap plates or sieve trays, well known to those skilled in the art, used inside the shell of a rectifier to effect fractional distillation.

Alternately, the fractionation tower can comprise a suitable packing as is known in the art, in lieu of or in addition to the actual stages between the first and last actual stages. Such packing comprises suitable material that facilitates intimate gas/liquid contact. The gas/liquid contacting material may include, but is not limited to random packing and structured packing. Examples of these include: Gauze, structured packings such as Metal Max Pak®, Mellapak®, Flexipac®, Gempak®, Goodloe®, Sulzer®, or random or dumped packing, such as berl saddles, Intalox® saddles, raschig rings, Pall® rings, and Nutter Rings™. These and other types of suitable gas/liquid contacting equipment are described in detail in Kister, H. Z. Distillation Design, McGraw-Hill, N.Y. (1992), Chapters 6 and 8, the disclosures of which are incorporated herein by reference. Typically such materials are packed to a depth ranging from about 2 ft to about 40 ft (from about 0.6 m to about 12 m), say, from about 4 ft to about 20 ft (from about 1.2 m to about 6 m). The efficacy of the packing material is related to the trays which it replaces or supplements in terms of height equivalent per theoretical plate (HETP), a measure of mass-transfer efficiency. In a packed distillation column, it is the height of packing that makes a separation equivalent to that of a theoretical plate.

The gaseous effluent taken as overhead from the rectifier can have a temperature ranging from about 82° to about 149° C. (180° to 300° F.) and may be directed through at least one indirect partial condenser to condense the $C_5$+ components, e.g., pyrolysis gasoline, as well as water, in the effluent whose temperature is reduced by the condenser to about 37° C. (100° F.). Passing the effluent through at least one indirect partial condenser is conveniently arranged to lower the temperature of the effluent to about 20° to about 50° C. (68° to 122° F.), typically about 40° C. (100° F.) to condense additional light hydrocarbons, thereby reducing the density of the hydrocarbon phase and improving the separation of pyrolysis gasoline from water.

The resulting effluent from the indirect partial condenser (s) comprising a gaseous fraction and liquid pyrolysis gasoline fraction is then separated in a distillate drum into a gaseous overhead, an aqueous fraction derived from the diluting steam, and a hydrocarbonaceous fraction, e.g., a $C_5$ stream comprising pyrolysis gasoline. The gaseous overhead comprising cracked gas is directed to a recovery train for recovering $C_2$ to $C_4$ olefins. The hydrocarbonaceous fraction rich in pyrolysis gasoline can be recovered as product and/or recirculated to the rectifier as reflux. Alternatively, the gaseous effluent taken from the rectifier can be directed to a water quench tower where pyrolysis gasoline and water are condensed and the gas stream is cooled to about 38° C. (100° F.).

Typically, the pyrolysis gasoline fraction recovered has an initial boiling point of less than about 150° C. (302° F.) and final boiling point in excess of about 177° C. (350° F.), such as of the order of about 204° C. (400° F.).

The invention will now be more particularly described with reference to the examples shown in the accompanying drawings.

Referring to FIG. 1, in the method of an example of the invention, a hydrocarbon feed 100 comprising heavy gas oil, and dilution steam 102 are fed to a steam cracking reactor 104 where the hydrocarbon feed is heated to cause thermal decomposition of the feed to produce lower molecular weight hydrocarbons, such as $C_2$-$C_4$ olefins. The pyrolysis process in the steam cracking reactor also produces some tar and steam cracked gas oil.

Gaseous pyrolysis effluent 106 exiting the steam cracking furnace 104 initially passes through at least one primary transfer line heat exchanger 108 which cools the effluent from an inlet temperature ranging from about 704° to about 927° C. (1300° to 1700° F.), say, from about 760° to about 871° C. (1400° to 1600° F.), e.g., about 816° C. (1500° F.), to an outlet temperature ranging from about 316° to about 927° C. (600° to 1300° F.), say, from about 371° to about 649° C. (700° to 1200° F.), e.g., about 593° C. (1100° F.). The primary heat exchanger 108 comprises a water inlet 110 for introducing high pressure boiler feed water ranging from about 2172 kPa to about 17340 kPa (300 to 2500 psig), say, about 10450 kPa (1500 psig), and having a temperature ranging from about 104° C. to about 371° C. (220° to 700° F.), say, from about 121° C. to about 343° C. (250° F. to 650° F.), e.g., about 316° C. (about 600° F.). High pressure, saturated steam is taken from steam outlet 112. Typically, the pressure is substantially unchanged from the boiler feed water provided through water inlet 110. After leaving the primary heat exchanger 108, the cooled effluent stream 114 is then quenched with a liquid quench oil or liquid water, introduced via line 119 to the heat exchanger 108 effluent to provide supplemental cooling. The quenched heat exchanger effluent 120 is then passed into at least one tar knock-out drum 122 where the effluent is separated into a bottoms tar and coke fraction 124 and a gaseous fraction 126. The bottoms fraction can be cooled in a heat exchanger 123 to produce a cooled tar stream 125.

The tar knock-out drum gaseous fraction 126 passes through one or more cracked gas coolers 128, where the fraction is cooled to a temperature ranging from about 121° to about 204° C. (250° to 400° F.), such as from about 135° to 177° C. (275° to 350° F.), e.g., 149° C. (300° F.) by indirect heat transfer, e.g., with deaerated boiler feed water as the cooling medium. Gas coolers may also be used to raise medium pressure steam or low pressure steam. The cooled effluent 130 is then introduced to rectifier 132 at a level below the distillation plates or stages 134. The rectifier distills pyrolysis gasoline from heavier hydrocarbons using low level heat present in the effluent stream. The heavier hydrocarbons are taken as bottoms via line 136 which can be used at least in part as quench oil. The largely $C_{10}$ and lighter overhead taken via line 138 comprising pyrolysis gasoline and cracked gas is directed to condensers 140 and 142 which employ cooling water as a cooling medium introduced via line 144 at a temperature of about 27° C. (80° F.) which exits the downstream condenser 142 at a temperature of about 38° C. (100° F.) as heated stream 146 which is introduced to the upstream condenser 140 from which it is taken as heated stream 148 at a temperature of about 49° C. (120° F.). In the condensers, the stream is cooled to near ambient temperature and pyrolysis gasoline is condensed. Alternately, the condensers 140 and 142 can be replaced by a water quench tower as is well known in the art. The cooled stream 150 is directed to distillate drum 152 wherein the stream separates into a fraction rich in pyrolysis gasoline, taken as bottoms via line 154 which can be directed as reflux to the rectifier via line 155 to an inlet above the distillation stages and/or packing, or taken as product via line 156. A gaseous overhead fraction 158, can be fed directly to a recovery train as is known to those skilled in the art for compressing, cooling and separating of the $C_2$-$C_4$ olefins.

It will therefore be seen that the method of the invention, has several advantages over the prior art. It requires reduced investment, given the substitution of a rectifier for the more complex primary fractionator, while maximizing the value of recovered heat by recovering useful heat from the gas after the tar is separated out. Heat can be transferred directly from the effluent to external cooling services, avoiding the need for intermediate heat transfer streams and associated heat exchange equipment. Tar and coke are advantageously removed by the present method as early as possible in a dedicated vessel, minimizing fouling and simplifying coke removal. Liquid hydrocarbon inventory for the method is greatly reduced, while eliminating pumparound pumps. Fouling of pumparound exchangers is eliminated. The smaller rectifier has fewer trays or less packing, than the primary fractionator which it replaces, and thus has reduced susceptibility to fouling.

The present invention is especially suited for use with crackers that produce large quantities of pyrolysis gasoline and heavier hydrocarbons. The rectifier distills pyrolysis gasoline from heavier hydrocarbons using largely the heat present in the gas stream. In contrast, the use of a tailing tower to separate pyrolysis gasoline from heavier hydrocarbons requires substantial additional heat input to vaporize much of the feed and reboil the bottoms of the tower. Stripping steam may also be required with the tailing tower, to keep temperatures low. The rectifier provides an overhead stream essentially free of heavy hydrocarbons, making it a suitable feed to a water quench tower or indirect condenser.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

What is claimed is:

1. A method for treating gaseous effluent from a hydrocarbon pyrolysis unit, the method comprising:

(a) cooling said gaseous effluent at least to a temperature at which tar, formed by reaction among constituents of the gaseous effluent, condenses;

(b) passing a mixed gaseous and liquid effluent from step (a) through at least one vapor-liquid separator, where the condensed tar separates from the gaseous effluent and the condensed tar is removed from the method as separator bottoms;

(c) cooling the tar-depleted gaseous effluent from step (b) in one or more cracked gas coolers to condense a liquid effluent quench oil;

(d) passing at least a portion of the effluent from step (c) containing liquid effluent quench oil through at least one rectifier comprising a fixed number of distillation stages ranging from about 2 to about 20 and/or equivalent suitable packing and comprising a reflux inlet for introducing a pyrolysis gasoline fraction, and further, obtaining liquid effluent quench oil as rectifier bottoms;

(e) cooling the gaseous effluent from step (d) to condense a liquid effluent comprising pyrolysis gasoline and water condensed from steam;

(f) treating a mixed gaseous and liquid effluent from step (e) to at least partially separate therefrom a liquid pyrolysis gasoline rich stream; and (g) passing at least a portion of the liquid pyrolysis gasoline rich stream as reflux to said rectifier.

2. The method of claim 1, wherein the gaseous effluent is cooled in step (a) to a temperature of less than about 371° C. (700° F.), cooled in step (c) to a temperature of less than about 316° C. (600° F.), and cooled in step (e) to a temperature of less than about 104° C. (220° F.).

3. The method of claim 1, wherein the gaseous effluent is cooled in step (a) to a temperature ranging from about 232° to about 316° C. (450 to 600° F.), cooled in step (c) to a temperature ranging from about 93° to about 232° C. (200° to 450° F.), and cooled in step (e) to a temperature ranging from about 15° to about 93° C. (60° to 200° F.).

4. The method of claim 1, wherein the gaseous effluent is cooled in step (a) to a temperature ranging from about 249° to about 293° C. (480° to 560° F.), cooled in step (c) to a temperature ranging from about 121° to about 176° C. (250° to 350° F.), and cooled in step (e) to a temperature ranging from about 32° to about 88° C. (90° to 190° F.).

5. The method of claim 1, wherein said liquid pyrolysis gasoline rich stream has an initial boiling point of less than about 66° C. (150° F.) and a final boiling point in excess of about 149° C. (300° F.).

6. The method of claim 5, wherein said liquid pyrolysis gasoline rich stream has a final boiling point ranging from about 177° to about 454° C. (350° to 850° F.).

7. The method of claim 1, wherein step (a) includes passing the effluent through a primary transfer line heat exchanger which provides steam having a temperature of at least about 254° C. (489° F.) and pressure greater than about 4240 kPa (600 psig).

8. The method of claim 7, wherein step (a) includes passing the effluent through a primary transfer line heat exchanger which provides steam having a temperature ranging from about 254° to about 677° C. (489° to 1250° F.) and pressure ranging from about 4240 to about 17340 kPa (600 to 2500 psig).

9. The method of claim 7, wherein step (a) includes passing the effluent from the primary transfer line heat exchanger to a secondary transfer line heat exchanger wherein at least a substantial portion of said tar is condensed.

10. The method of claim 8, wherein step (a) includes maintaining an outlet temperature for said primary transfer line heat exchanger above the dew point of its effluent.

11. The method of claim 1, wherein step (a) is at least partially effected by direct quench of the gaseous effluent with a liquid quench stream.

12. The method of claim 11, wherein said liquid quench stream is selected from water and oil.

13. The method of claim 12, wherein said liquid quench stream comprises condensed quench oil from step (d).

14. The method of claim 8, wherein step (a) comprises directly contacting the gaseous effluent with a quench liquid after passage of the effluent through said primary transfer line heat exchanger.

15. The method of claim 14, wherein said quench liquid is selected from water and oil.

16. The method of claim 15, wherein said quench liquid comprises condensed quench oil from step (d).

17. The method of claim 1, wherein said rectifier comprises at least one tray.

18. The method of claim 1, wherein the cooling step (c) is effected by indirect contact heat exchange.

19. The method of claim 1, wherein the gaseous effluent of step (a) is derived from pyrolysis of a naphtha feed.

20. The method of claim 1, wherein the gaseous effluent of step (a) is derived from pyrolysis of a feed heavier than naphtha.

21. The method of claim 1, wherein the cooled gaseous effluent, liquid pyrolysis gasoline and liquid water from step (e) are at least partially separated in a distillate drum from each other to form a gaseous effluent stream which is directed to a recovery train, a liquid pyrolysis gasoline rich stream and a liquid water rich stream.

22. The method of claim 1, wherein the liquid pyrolysis gasoline rich stream has a lower end point than a corresponding stream made from a corresponding method excluding step (d).

23. A method for treating gaseous effluent from a hydrocarbon pyrolysis unit, the method comprising:

(a) passing the gaseous effluent derived from pyrolysis of a feed heavier than naphtha through at least one primary heat exchanger, thereby cooling the gaseous effluent and generating super high pressure steam;

(b) passing a mixed gaseous and liquid effluent from step (a) through at least one vapor-liquid separator, where tar, formed by reaction among constituents of the effluent is condensed and separates from the gaseous effluent and the condensed tar is removed from the method as separator bottoms;

(c) cooling the gaseous effluent from step (b) to condense a liquid effluent quench oil;

(d) passing a mixed gaseous and liquid effluent from step (c) through at least one rectifier comprising distillation media selected from trays and packing and a reflux inlet for introducing a pyrolysis gasoline fraction, where condensed quench oil separates from the gaseous effluent;

(e) cooling the gaseous effluent from step (d) to condense a liquid effluent comprising pyrolysis gasoline and water condensed from steam;

(f) treating the gaseous and/or liquid effluent from step (e) to at least partially separate therefrom a liquid pyrolysis gasoline rich stream; and (g) passing at least a portion of the liquid pyrolysis gasoline rich stream as reflux to said rectifier.

* * * * *